US005338041A

United States Patent [19]

Jones et al.

[11] Patent Number: 5,338,041

[45] Date of Patent: Aug. 16, 1994

[54] SPORTS CHESS GAME APPARATUS

[76] Inventors: David R. Jones, 4 Downing Cr., Bloomington, Ill. 61704; Garry L. Winterland, 204 Florence, Bloomington, Ill. 61701; David A. Cripe, 1324 Kenneth, Bloomington, Ill. 61704

[21] Appl. No.: 120,054

[22] Filed: Sep. 13, 1993

[51] Int. Cl.[5] ..... A63F 3/02

[52] U.S. Cl. ..... 273/260; 273/259; 273/284; 273/287; D21/24; D21/28; D21/29

[58] Field of Search ..... 273/284, 287, 260, 259, 273/240, 247; D21/24, 27-29

[56] References Cited

U.S. PATENT DOCUMENTS

| | | | |
|---|---|---|---|
| D. 21,679 | 7/1892 | Martindale | D21/24 |
| D. 113,701 | 3/1939 | Bockemuehl | D21/24 |
| D. 231,542 | 4/1974 | Munson | D21/24 |
| 2,586,017 | 2/1952 | Freedman | D21/24 |
| 3,913,921 | 10/1975 | Bourassa | 273/157 A |

OTHER PUBLICATIONS

Joan Cook Catalog "Official Football Chess" Oct. 10, 1972 p. 36.

*Primary Examiner*—Benjamin H. Layno
*Attorney, Agent, or Firm*—E. Michael Combs

[57] ABSTRACT

A housing having a top wall of a chess board pattern is arranged to selectively receive groupings of chess pieces configured in representative relationship to a respective category of sports to include football, hockey, baseball, and basketball. A transparent laminate web is arranged for selective mounting and frictional adhering to the top wall to indicate relative to each representative group of chess pieces.

3 Claims, 4 Drawing Sheets

SPORTS CHESS GAME APPARATUS

BACKGROUND OF THE INVENTION

1. Field of the Invention

The field of invention relates to chess game apparatus, and more particularly pertains to a new and improved sports chess game apparatus wherein the same is arranged to include players configured to designate various categories of sporting events.

2. Description of the Prior Art

Chess game structure of various types are indicated in the prior art and exemplified by the U.S. Pat. Nos. 4,927,157; 4,778,187; 4,211,420; 4,856,789; and 4,300,768.

The instant invention attempts to overcome deficiencies of the prior art by providing for enhanced entertainment and amusement of individuals by employing chess components representative of sporting events of contemporary society.

SUMMARY OF THE INVENTION

In view of the foregoing disadvantages inherent in the known types of chess game apparatus now present in the prior art, the present invention provides a sports chess game apparatus including a plurality of sets of designated players arranged for positioning and storage within a housing representative of various sporting designations. As such, the general purpose of the present invention, which will be described subsequently in greater detail, is to provide a new and improved sports chess game apparatus which has all the advantages of the prior art chess game apparatus and none of the disadvantages.

To attain this, the present invention provides a housing having a top wall of a chess board pattern arranged to selectively receive groupings of chess pieces configured in representative relationship to a respective category of sports to include football, hockey, baseball, and basketball. A transparent laminate web is arranged for selective mounting and frictional adhering to the top wall to indicate relative to each representative group of chess pieces.

My invention resides not in any one of these features per se, but rather in the particular combination of all of them herein disclosed and,claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sports chess game apparatus which has all the advantages of the prior art chess game apparatus and none of the disadvantages.

It is another object of the present invention to provide a new and improved sports chess game apparatus which may be easily and efficiently manufactured and marketed.

It is a further object of the present invention to provide a new and improved sports chess game apparatus which is of a durable and reliable construction.

An even further object of the present invention is to provide a new and improved sports chess game apparatus which is susceptible of a low cost of manufacture with regard to both materials and labor, and which accordingly is then susceptible of low prices of sale to the consuming public, thereby making such sports chess game apparatus economically available to the buying public.

Still yet another object of the present invention is to provide a new and improved sports chess game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
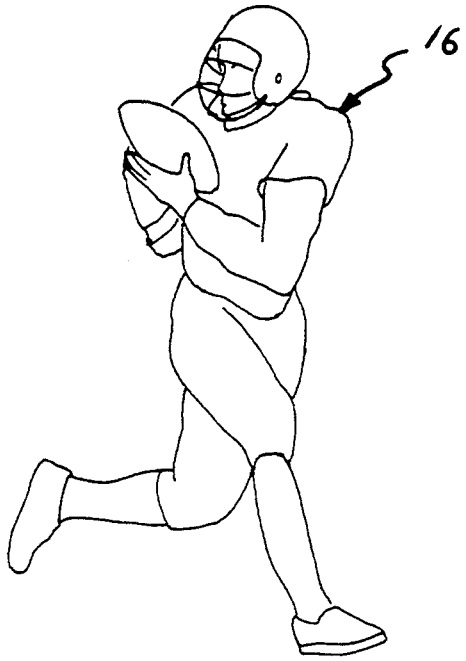
FIG. 1 is an isometric illustration of a first category of player.
Figure 2:
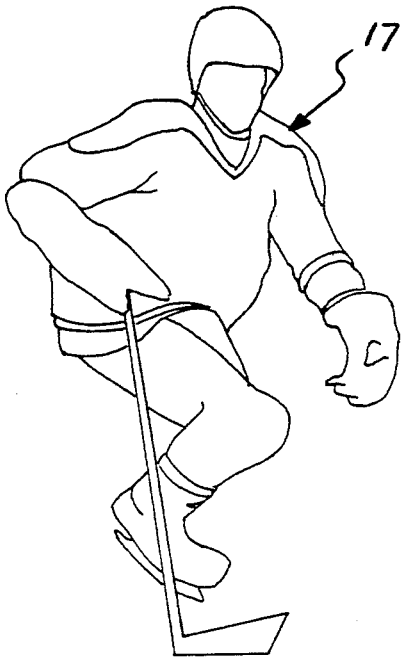
FIG. 2 is a representative indication of a second category of player.
Figure 3:
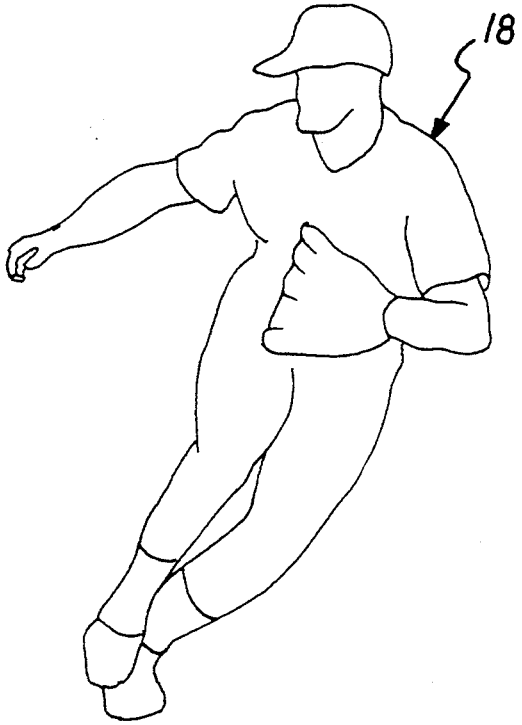
FIG. 3 is an orthographic view of a third category of player token.
Figure 4:
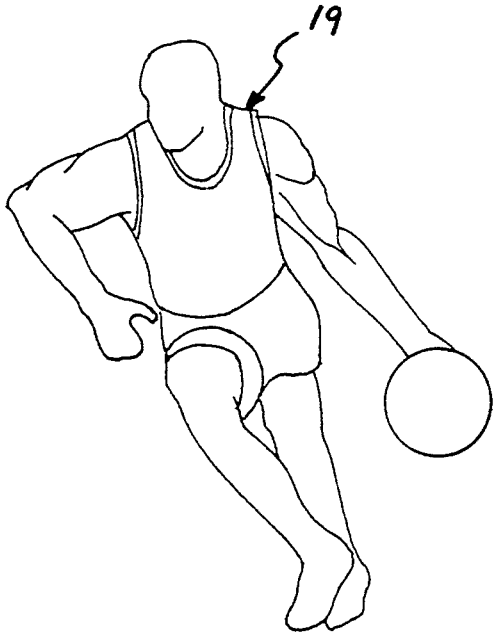
FIG. 4 is an orthographic view of a fourth category of player token.
Figure 5:
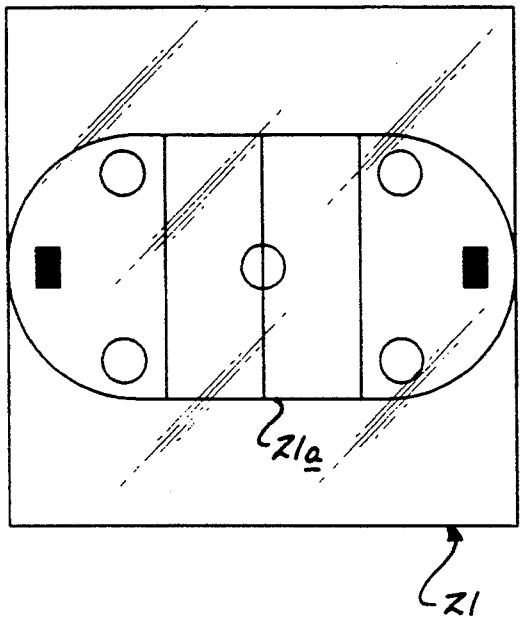
FIGS. 5–8 are orthographic top views of individual flexible polymeric webs to indicate various sporting event fields of play.

With reference now to the drawings, and in particular to FIGS. 1 to 11 thereof, a new and improved sports chess game apparatus embodying the principles and concepts of the present invention and generally designated by the reference numeral 10 will be described.

More specifically, the sports chess game apparatus 10 of the instant invention essentially comprises a housing 11 having spaced side walls 12, a rear wall spaced from a front wall 13, and a top wall 14, having a chess board pattern 15 of a type as indicated in conventional prior art such as indicated in U.S. Pat. No. 4,300,768 relative to the chess board pattern alone. The FIGS. 1–4 indicate respective first, second, third, and fourth category of player tokens 16, 17, 18, and 19 respectively to indicate players for association of contemporary sporting events, and specifically that of football, hockey, baseball, and basketball respectively. The players may be individually numbered or alternatively individually configured, where it is understood that each of the sets of tokens 16–19 are of sufficient number and contrasting colorations to indicate plural sets of opposing players for use in conventional chess game, with such movement of players controlled by conventional chess rules. The number of individual players relative to use of play of a chess game is known in the prior art and details to such numbering and their various players such as to provide for representation and operative association to the chess player tokens of the "pawns, bishops, castles, knights, queen, king", and the like are per se known in the prior art.

Figure 6:
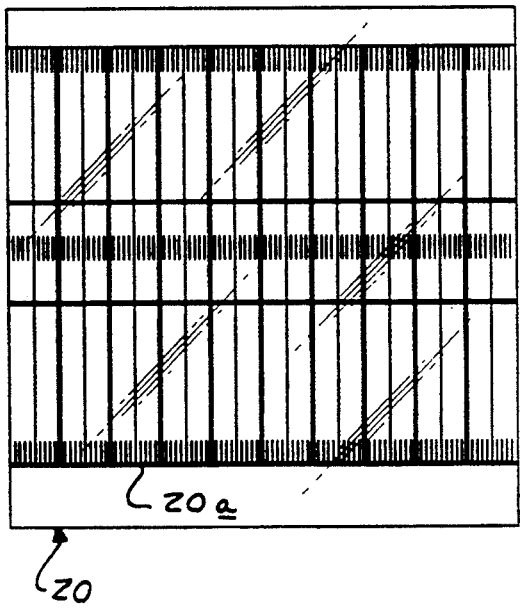
Figure 7:
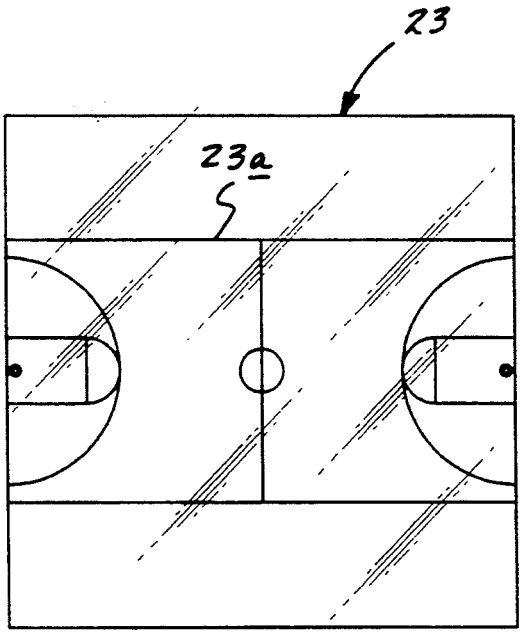
Figure 8:
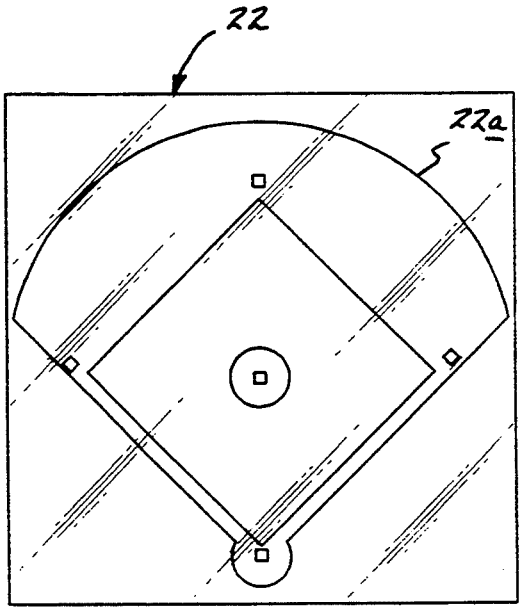
Figure 9:
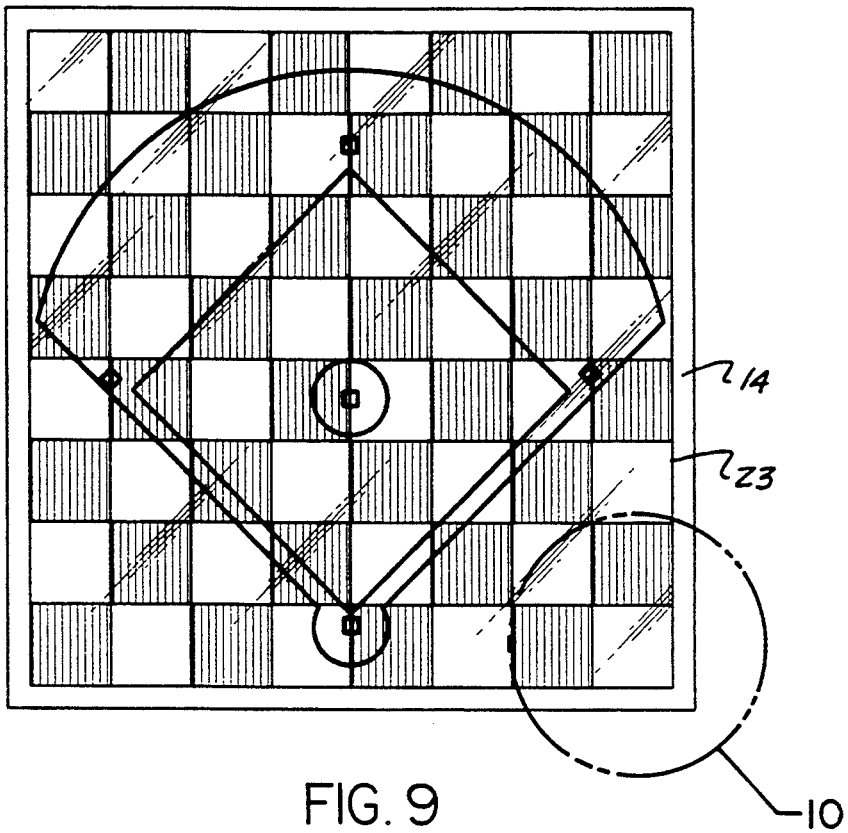
FIG. 9 is an orthographic top view of the housing structure.
Figure 10:
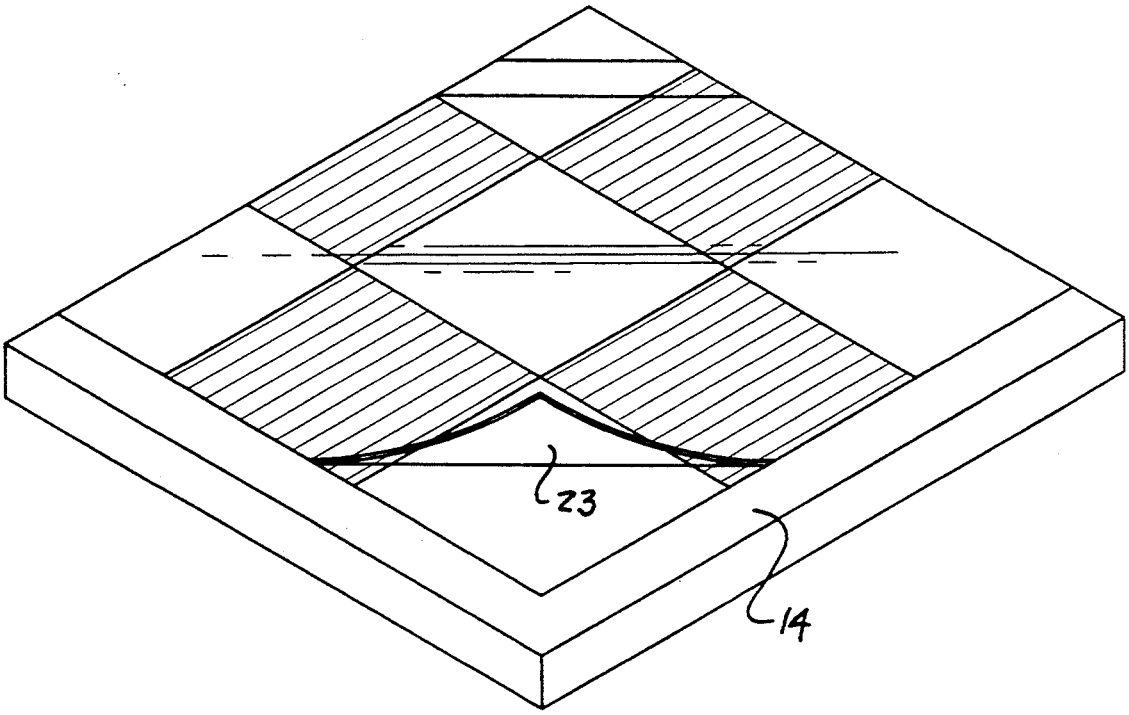
FIG. 10 is an isometric enlarged view of section 10 as set forth in FIG. 9.
Figure 11:
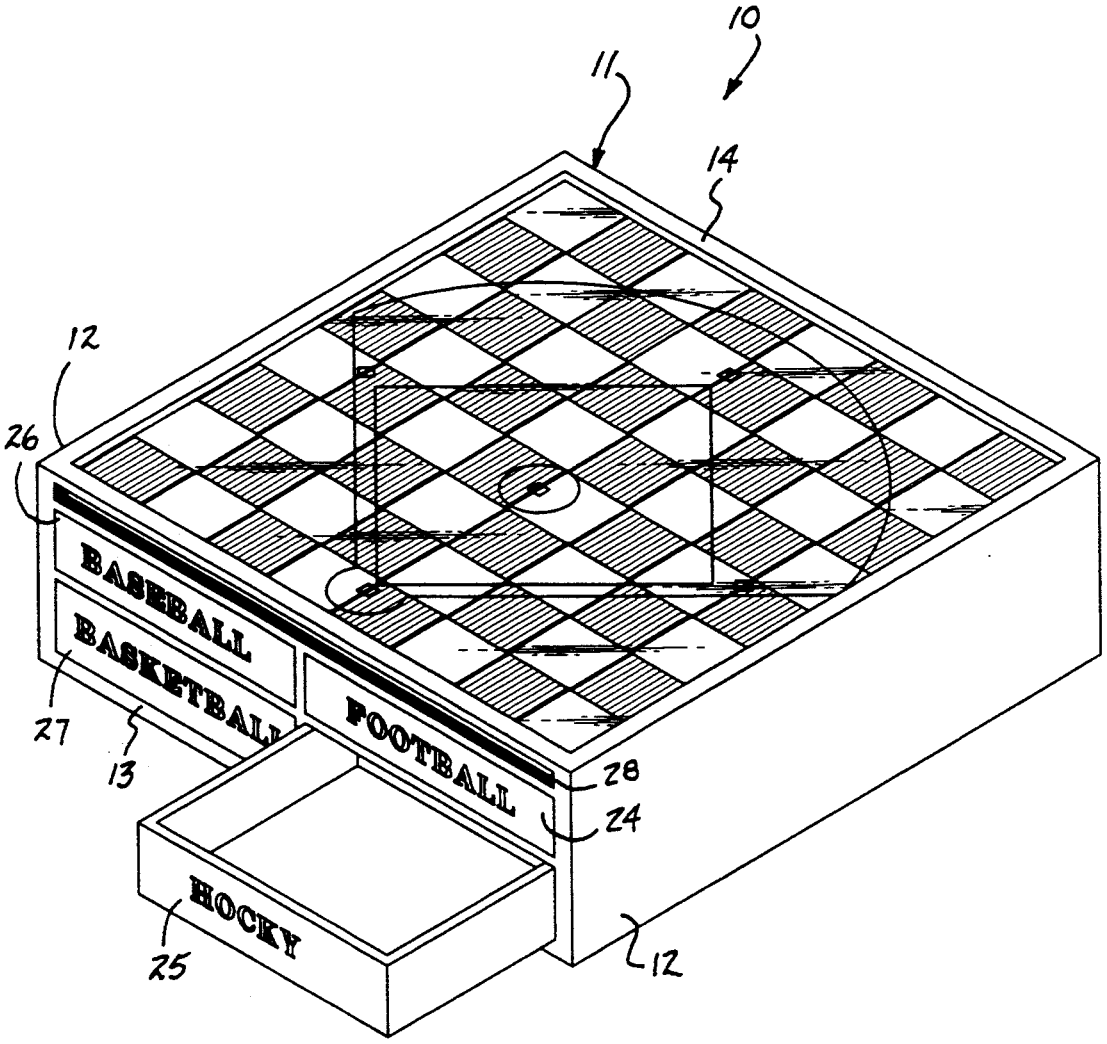
FIG. 11 is an isometric illustration of the game apparatus and associated housing structure.

The FIG. 6 indicates a first flexible polymeric web 20 having a football field representation 20*a* printed thereon for frictional adherence to the top wall 14 specifically coextensively over the chess board pattern 15. The web 20, as well as the second web 21, the third web 22, and the fourth web 23 are each of transparent construction, with the second web 21 having a hockey field 21*a* representation, the third web 22 having a baseball representation 22*a*, with the fourth web 23 having a basketball field representation 23*a*. The various designations in use with the webs provide for indication of the category of players 16–19 to be employed. The front wall 13 of the housing 11 includes first, second, third, and fourth slide drawers 24, 25, 26, and 27 respectively to secure the respective first through fourth respective player tokens sets 16–19. A slot 28 directed between the slide drawers and the top wall 14 is arranged to receive the polymeric webs preventing their wrinkling and distortion for mounting upon the top wall 14 in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A sports chess game apparatus, comprising, a housing having spaced side walls, a rear wall, a front wall, and a top wall, with a chess board pattern positioned within the top wall, and at least a first group of player tokens and a second group of player tokens, with the first group of player tokens of a first sporting event designation, and the second group of player tokens of a second sporting event designation, and a first flexible polymeric web positioned for frictional adherence complementarily over the chess board pattern, having a first sporting event field representation imprinted thereon, with the first web of a transparent construction, and a second flexible polymeric web of a transparent construction having a second sporting event field representation imparted thereon, with the second web arranged for complementary mounting over the chess board pattern.

2. An apparatus as set forth in claim 1 including at least a first slide drawer and a second slide drawer directed through the front wall arranged for receiving the first player tokens within the first slide drawer and the second player tokens within the second slide drawer for storage of said first and second respective player tokens.

3. An apparatus as set forth in claim 2 including a slot cavity directed through the front wall for receiving the first web and the second web therewithin for storage of said first web and said second web.

* * * * *